US009851097B2

(12) United States Patent
Rop

(10) Patent No.: US 9,851,097 B2
(45) Date of Patent: Dec. 26, 2017

(54) STEAM WATER SEPARATOR, USE OF SUCH WATER STEAM SEPARATOR, AND METHOD FOR SEPARATING STEAM AND WATER

(75) Inventor: Peter Simon Rop, Zoetermeer (NL)

(73) Assignee: NEM Energy B.V. (NL)

( * ) Notice: Subject to any disclaimer, the term of this patent is extended or adjusted under 35 U.S.C. 154(b) by 1474 days.

(21) Appl. No.: 13/263,888

(22) PCT Filed: Apr. 16, 2010

(86) PCT No.: PCT/NL2010/000069
§ 371 (c)(1),
(2), (4) Date: Oct. 21, 2011

(87) PCT Pub. No.: WO2010/120170
PCT Pub. Date: Oct. 21, 2010

(65) Prior Publication Data

US 2012/0031351 A1 Feb. 9, 2012

Related U.S. Application Data

(60) Provisional application No. 61/218,214, filed on Jun. 18, 2009.

(30) Foreign Application Priority Data

Apr. 16, 2009 (NL) ..... 2002758

(51) Int. Cl.
*F22B 37/26* (2006.01)

(52) U.S. Cl.
CPC ..... *F22B 37/26* (2013.01); *F22B 37/261* (2013.01)

(58) Field of Classification Search
CPC ..... F22B 37/22; F22B 37/26; F22B 37/303; F22B 37/261; F22B 37/30
USPC ..... 122/491, 438, 459, 488, 34
See application file for complete search history.

(56) References Cited

U.S. PATENT DOCUMENTS 1,948,524 A 1/1933 Kerr
2,743,709 A 5/1956 Armacost
3,373,544 A 3/1968 Catlin et al.
3,704,693 A * 12/1972 Hansen ..... 122/406.1
(Continued)

FOREIGN PATENT DOCUMENTS

FR 2653208 A1 4/1991
GB 2142420 A * 1/1985 ..... F22D 11/00
(Continued)

OTHER PUBLICATIONS

PCT Search Report and Written Opinion dated Dec. 20, 2011.
English translation of FR 2653208 (A1).
English translation of WO 1996/017208.

*Primary Examiner* — Steven B McAllister
*Assistant Examiner* — Ko-Wei Lin

(57) ABSTRACT

A steam water separator includes: —a vessel having a vessel wall delimiting an interior of the vessel, where the vessel is configured to contain steam in a steam zone and water in a water zone in the interior of the vessel, —at least one inlet for introducing steam and/or water in the vessel, —at least one steam outlet for taking steam out of the vessel, —at least one water outlet for taking water out of the vessel, and a wetting device configured to wet in the steam zone an inner surface of the vessel wall.

16 Claims, 2 Drawing Sheets

(56) References Cited

U.S. PATENT DOCUMENTS

| | | | | |
|---|---|---|---|---|
| 5,870,975 | A * | 2/1999 | Luc | 122/39 |
| 2008/0302314 | A1 * | 12/2008 | Gonzalez et al. | 122/1 R |

FOREIGN PATENT DOCUMENTS

| | | | | |
|---|---|---|---|---|
| WO | 96/17208 | A1 | 6/1996 | |
| WO | WO 2009044358 | A2 * | 4/2009 | D06F 75/18 |

* cited by examiner

STEAM WATER SEPARATOR, USE OF SUCH WATER STEAM SEPARATOR, AND METHOD FOR SEPARATING STEAM AND WATER

CROSS-REFERENCE TO RELATED APPLICATIONS

This application is the National Stage of International Application No. PCT/NL2010/000069, filed Apr. 16, 2010, which claims the benefit of Netherlands Application No. 2002758, filed Apr. 16, 2009, and U.S. Provisional Application No. 61/218,214, filed Jun. 18, 2009, the contents of which are of which are incorporated by reference herein.

FIELD OF THE INVENTION

The invention relates to a steam water separator. Such separator may comprise a drum or vessel in which a mixture of steam and water is held. The interior of the separator can be divided in a steam zone and a water zone. The water zone will normally be located at the bottom side of the separator, while the steam zone is arranged at the top side of the separator. The water surface of the water in the separator normally forms the border between the steam zone and the water zone.

The vessel is provided with at least one inlet for or steam and/or water, and at least one steam outlet for taking steam out of the vessel and at least one water outlet for taking water out of the vessel. The steam output of the separator may for instance be used as input for a steam turbine for the generation of electricity.

The heating of the water may be performed outside the separator itself, for instance by a furnace arranged under the separator vessel. A steam water separator together with a device in or by which steam is generated by heating water, is often referred to as boiler or steam generator. In the context of the present invention such boiler or steam generator is also regarded to be a steam water separator.

In a particular embodiment of a steam generator, the heating of the water is generated by solar energy. For instance, a panel-shaped array of tubes may be arranged such that via a number of reflectors mounted on heliostats solar energy may be directed on the tubes. This solar energy may be used to heat water in the tubes to generate steam. The steam-water mixture may be led to the separator, for separation of the steam from the steam-water mixture.

Typically, such process will be started and turned down frequently, since the sun is not always available. As a result, the steam water separator will be heated up and cooled down frequently.

BACKGROUND OF THE INVENTION

A drawback of the steam generator, in particular during heating up and cooling down is that the heat transfer coefficient between water and the vessel wall material, for instance steel, is substantially different from than the heat transfer coefficient between steam and the vessel wall material. The wall of the vessel next to the steam zone may therefore during start-up expand faster and/or at a earlier stage than the wall of the vessel next to the water zone due to the different rate of warming up. Similarly during turning down of the process, the wall of the vessel next to the steam zone may contract at a later stage than the wall of the vessel next to the water zone contract slower and/or at a later stage than the wall of the vessel next to the water zone.

Due to uneven expansion of the vessel wall, the vessel may bend over its longitudinal axis. This effect which is also referred to as 'drum humping', is undesired as it introduces undesired mechanical stresses within the vessel wall. In particular, when the process is often started-up and turned down, the mechanical stresses may lead to fatigue of the material and mechanical failure.

SUMMARY OF THE INVENTION

It is an object of the invention to overcome the above-mentioned drawback and/or to provide at least a useful alternative.

The object of the invention is achieved with a steam water separator comprising a vessel having a vessel wall delimiting an interior of the vessel, wherein the vessel is configured to contain steam in a steam zone and water in a water zone in the interior of the vessel, at least one inlet for introducing steam and/or water in the vessel, at least one steam outlet for taking steam out of the vessel, and at least one water outlet for taking water out of the vessel, characterized in that the separator comprises a wetting device configured to wet in the steam zone an inner surface of the vessel wall.

By wetting the inner surface of the vessel wall in the steam zone, the heat transfer coefficient and imposed medium temperature are substantially equal over the inner surface of the vessel wall in the water zone and the steam zone. As a result, the expansion of the vessel wall during start-up and the contraction of the vessel wall during turning down of the process will be substantially similar over the vessel wall. Bending of the vessel due to uneven expansion and contraction is at least decreased.

The wetting device is preferably configured to wet substantially the whole inner surface of the vessel wall, or at least a substantial part thereof. For instance, in a cylindrical vessel, at least the inner surface of the cylindrical parts of the vessel wall may be wetted by the wetting device. It is also possible that only parts of the inner surface of the vessel wall are wetted by the wetting device such that the heat transfer coefficient in the steam zone of the vessel are increased to a level that the expansion and contraction of the vessel wall bordering the steam zone and the water zone are substantially similar.

The term vessel refers to a device having an interior in which a quantity of steam and water is held in order to separate the steam from the water. The vessel wall encloses this interior of the vessel, and preferably forms substantially the outer wall of the vessel, i.e. the wall which is arranged between the interior of the vessel and the environment.

The vessel wall may comprise multiple material layers. The inner surface of this vessel wall is formed by the inner surface of the inner layer of this vessel wall, i.e. the surface which is in contact with the interior of the vessel.

The vessel of the steam-water separator may be a pressure vessel, i.e. the pressure in the interior of the vessel is different than the pressure in the environment. Such pressure vessel is closed from the environment to maintain this different pressure.

In an embodiment, the wetting device is configured to provide a water film on substantially the whole inner surface of the vessel wall in the steam zone. By providing a water film on the inner surface in the steam zone, the inner surface of the vessel wall is in both the water zone and the steam zone only in contact with water. Thus, over substantially the whole inner surface a substantially equal heat transfer coefficient is obtained between the interior of the vessel and the vessel wall.

In an embodiment, the wetting device comprises one or more nozzles arranged in an interior of the vessel and directed at the inner surface of the vessel wall in the steam zone. The nozzles are configured to provide a number of water jets which hit the inner surface of the vessel wall for wetting of the vessel wall.

In an embodiment, the one or more nozzles are directed at substantially the whole inner surface of the vessel wall in the steam zone. Thus the nozzles produce water jets which are aimed to wet substantially the whole inner surface of the vessel wall.

In an embodiment, the one or more nozzles are directed at only an upper region of the inner surface of the vessel wall in the steam zone. In such embodiment, the water which is jetted against the inner surface of the vessel wall in an upper region of the vessel, will run down the inner surface of the vessel wall to the water zone in the bottom side of the vessel. The water running down the inner vessel wall will form a water film on the inner surface of the vessel wall.

In an embodiment, the wetting device comprises at least in the steam zone a wall element to provide a space between the vessel wall and the wall element, and wherein the wetting device comprises at a top side of the vessel a wetting water inlet to substantially fill the space between vessel wall and wall element. The wall element is preferably a plate shaped element which is formed in conformity with the inner surface of the vessel wall such that the distance between the wall element and the inner surface of the vessel wall is over the whole area of the wall element substantially the same.

At the top side of the vessel, a wetting water inlet is provided to introduce water in the space between the wall element and the inner surface of the vessel wall. By filling the space a layer of water is created in the steam zone between the steam and the inner surface of the vessel wall. As a result, the inner surface of the vessel wall is in direct contact with water and the heat transfer coefficient from the interior of the vessel to the wall of the vessel is substantially the same over the inner surface of the vessel wall. The distance between the wall element and the inner surface of the vessel wall is preferably just large enough to form a layer of water on the inner surface of the vessel wall without the need of large amounts of water.

In an embodiment the water used in the wetting device is taken from the water in the vessel itself A pump may be provided to pump the water from the water zone to the steam zone. The pump may be arranged in the vessel or outside the vessel. This ensures an equal imposed medium temperature on the inner surface of the wall in the steam and water zone.

In an embodiment, a water outlet is arranged at the bottom side of the vessel so that water can be taken out of the water zone. The water is pumped via a conduit, arranged in or outside the vessel to the wetting device When the wetting device comprises one or more nozzles the nozzles may be connected to the conduit. When multiple nozzles are provided a manifold may be placed between the conduit and the nozzles to divide the water over the multiple nozzles.

The steam water separator according to the invention may in particular be used in a process with a frequently changing process temperature and/or in a process which is frequently started and stopped. During such change of temperature, and in particular during start-up and turning down of the process the wetting device may be used to avoid bending of the vessel due to an uneven expansion of the vessel wall in the upper region, i.e. at the steam zone, and the lower region of the vessel, i.e. at the water zone.

The steam generator of the invention may also in particular be used in a solar power installation. In such installation the process is often started and stopped since the sun is not always available for heating of the water to produce steam for the steam turbine. During starting and stopping of the process it is desirable to use the wetting device according to the invention to avoid bending of the vessel of the steam water separator.

The invention further relates to a method for separating steam and water, comprising the steps of:

providing a steam water separator comprising a vessel configured to contain steam and water, at least one inlet for water or a mixture of steam and water, at least one steam outlet, and at least one water outlet, supplying a mixture of steam and water, and taking out steam via the steam outlet, taking out water via the water outlet, characterized by wetting an inner surface of the vessel wall above a water level of the vessel.

The steam zone and the water zone meet each other at the water level in the vessel. By wetting the inner surface of the vessel wall above the water level a layer or water of a water film may be obtained on this inner surface in the steam zone. As a result, the heat transfer coefficient and imposed medium temperature are substantially equal for the inner surface of the vessel wall in both the steam zone and the water zone.

By applying this method 'drumhumping' of the vessel can be decreased or even be avoided.

In an embodiment, the wetting of the inner surface of the vessel wall is established by spraying water against the inner surface of the vessel wall. The spraying of water may be performed by a number of nozzles arranged in the interior of the vessel. In an alternative embodiment the layer of water against the inner surface of the vessel wall may be created by filling a space provided between the inner surface of the vessel wall and a wall element arranged in the interior of the vessel with water. The wall element may be a plate-shaped element which is formed in conformity with the inner surface of the vessel wall, so that a small gap is present between the inner surface of the vessel wall and the wall element over substantially the whole surface area of the wall element.

BRIEF DESCRIPTION OF THE DRAWINGS:

The invention will be explained in more detail with reference to the appended drawings which illustrate a practical embodiment of the invention, but should not be regarded as limiting, wherein.

Figure 1:
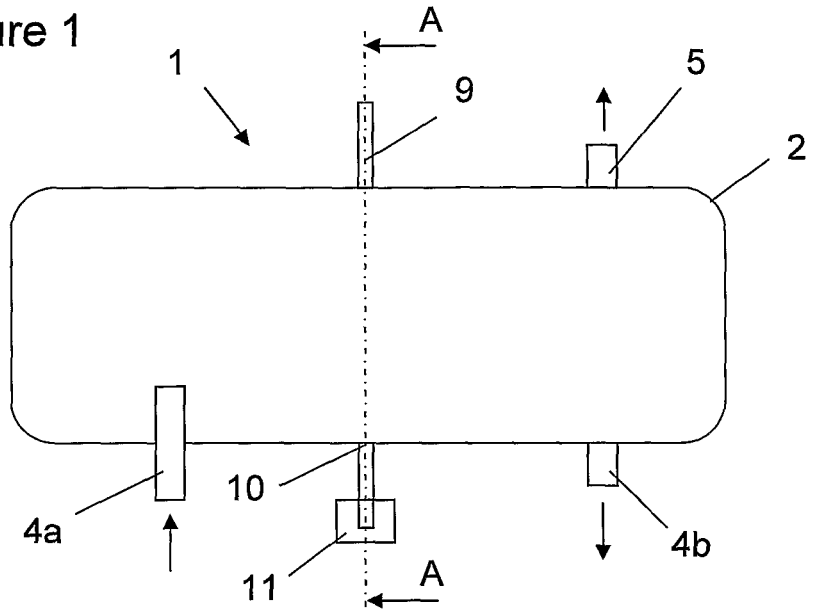
FIG. 1 shows a side view of a steam water separator according to the invention.

DETAILED DESCRIPTION OF THE INVENTION:

FIG. 1 shows a steam water separator generally indicated by the reference numeral 1. The steam water separator 1 comprises a vessel 2 having a vessel wall 3 enclosing an interior of the vessel 2. The vessel 2 is a horizontally orientated vessel, i.e. the longitudinal axis of the cylindrical vessel 2 extends in horizontal direction. The vessel wall may comprise one or more material layers of suitable material, for instance a combination of a steel inner and outer layer with a layer of insulation material between the inner and outer layer.

The steam water separator 1 is part of a solar power station (not shown) which uses solar power to heat water to obtain a mixture of steam and water, for instance in an array of tubes which are heated by solar energy. The steam water separator 1 is configured to separate the steam from the water. A mixture of steam and water is introduced in the vessel via the inlets 4*a*. Steam is taken from the vessel via the steam outlet 5 which is arranged in an upper region of the vessel 2. The steam is led to a steam turbine, in which the steam is used for the generation of electrical energy. The water in the vessel 2 is taken out of the vessel at a lower region of the vessel 2 at water outlet 4*b* and recirculated to the array of tubes for renewed heating of the water for the generation of steam.

Figure 2:
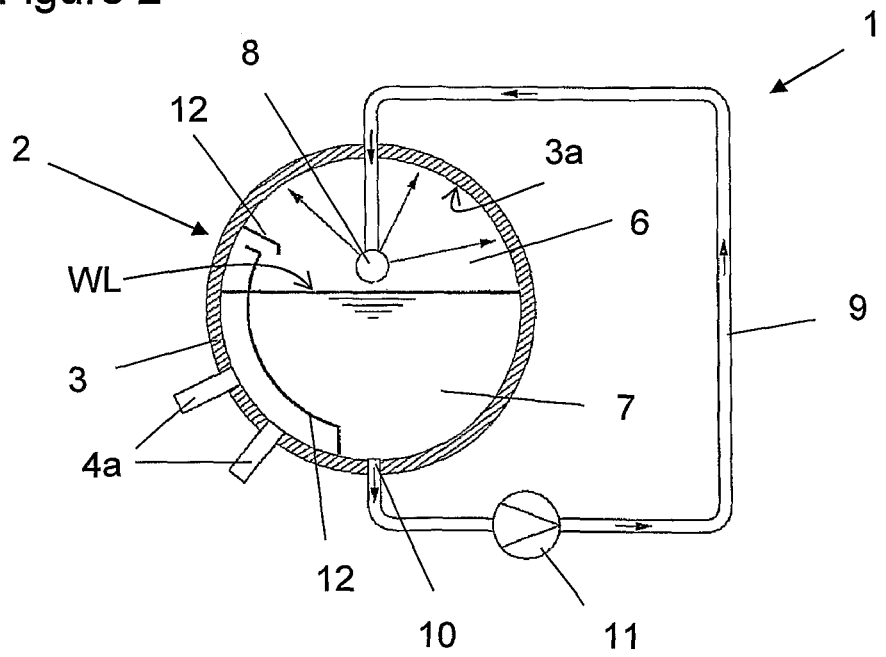
FIG. 2 shows a cross section of the separator of FIG. 1 along the line A-A.

FIG. 2 shows a cross section of the vessel 2 along the line A-A. Due to the different densities of steam and water, steam will accumulate in the upper region of the vessel 2, while water will remain in the bottom region of the vessel. Therefore, the interior of the vessel may be divided in a steam zone 6 in the upper region of the vessel 2 and a water zone 7 in the lower region of the vessel 2. The water level WL of the water within the vessel forms the border between the steam zone 6 and the water zone 7. The height of the water level may change due to different ratios between steam and water, but will usually be held at the same height by a control device.

The mixture of steam and water is introduced in the interior of the vessel through the inlets 4*a*. In the vessel wall elements 12 are provided which divide an inlet space from the rest of the interior of the vessel. The advantage of such inlet space is that the mixture of steam and water that enters the vessel will first come in the inlet space in which the major part of the steam may separate from the water, therewith avoiding turbulence in the rest of the interior of the vessel and therewith renewed mixing of steam and water. Further internal means may be provided in the interior of the vessel to further improve the separation of steam and water.

The steam water separator 1 comprises a wetting device having a nozzle 8. The nozzle 8 is arranged in the steam zone. The nozzle 8 is configured to form a number of water jets which are aimed at the inner surface 3*a* of the vessel wall 3 in the steam zone 6. The nozzle 8 is connected to a conduit 9 which runs outside the vessel 2 to a wetting water outlet 10 at the bottom side of the vessel 2. In the conduit 9 a circulation pump 11 is provided to pump water from the vessel 2 to the nozzle 8.

The nozzle 8 extends in the longitudinal direction of the vessel to cover the whole inner surface 3*a* in the steam zone 6. The nozzle may for instance be pipe-shaped and provided with jetting openings over the top surface of the pipe. As an alternative multiple nozzles 8 may be provided. In such embodiment, a manifold may be present for dividing the water over the different nozzles. The jetting openings may have any suitable shape and size.

By jetting water on the inner surface 3*a* a layer of water is obtained at the inner surface. As a result, the complete inner surface 3*a* of the vessel 2 both in the steam zone 6 and the water zone 7 is mainly in contact with water, and the imposed medium temperature and the heat transfer coefficient from the interior of the vessel 2 to the vessel wall 2 is over the whole vessel wall 2 substantially the same.

The advantage of such equal imposed medium temperature and heat transfer coefficient over the vessel wall is that during a change of temperature in the vessel 2, for instance during start-up or turning down of the process, the vessel wall will be warmed up or cooled at the same rate, resulting in an even expansion or contraction of the vessel wall 2 at the steam zone 6 and the water zone 7. In this way, bending of the vessel 2 as a result of uneven expansion or contraction of the vessel wall 2.

Therefore, the jetting of water against the inner surface 3*a* may only be performed during substantial temperature changes in the vessel 2, for instance during starting up or turning down of the process. The use of the wetting device is therefore in particular useful in a process wherein the process is frequently started and stopped, such as in a solar power installation.

Figure 3:
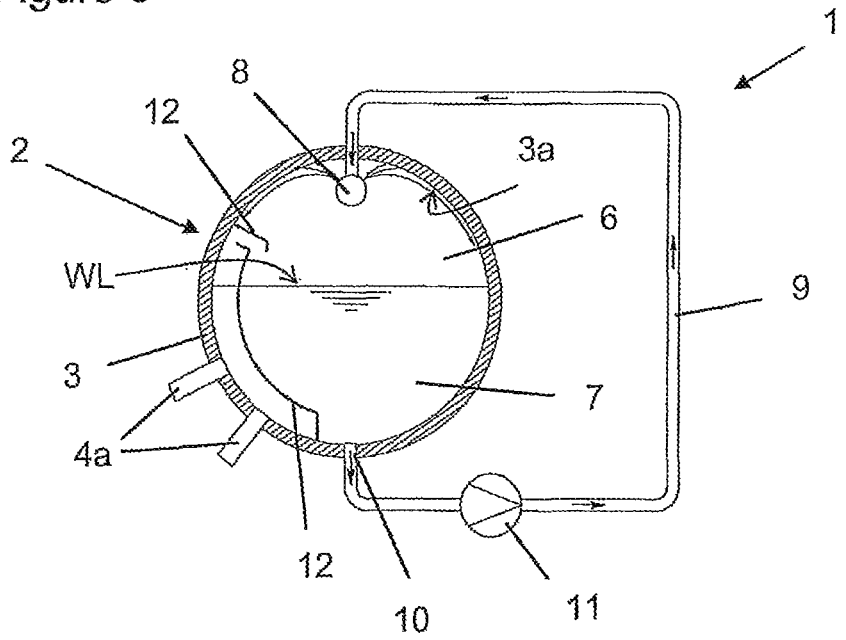
FIG. 3 shows a cross section of a first alternative embodiment of a separator according tot the invention.

FIG. 3 shows an alternative embodiment of steam water separator incorporating a wetting device according to the invention. The same or corresponding parts of the water steam separator 1 have been indicated by the same reference numerals.

The vessel 2 of FIG. 3 corresponds to the vessel 3 shown in FIG. 2 and will not be described in further detail.

The nozzle 8 is similar to the nozzle 8 of FIG. 2 is provided, but the nozzle 8 is arranged closer to the top of the vessel 2. As a result, the water jets provided by the nozzle 8 are only directed to the inner surface 3*a* at the top side of the vessel 2. Thus the water will only directly impinge on this upper side region of the inner surface 3*a* of the vessel wall, and not on substantially the whole inner surface 3*a* in the steam zone.

However, the water which is jetted on the inner surface 3*a* will run down the inner surface 3*a* of the vessel towards the water zone 7 in the lower side of the vessel 2, thereby forming a water film on the inner surface 3*a*. As a result, substantially the whole inner surface 3*a* of the vessel 3 in both the steam zone 6 and the water zone 7 is covered with a layer of water, therewith providing a substantially constant heat transfer coefficient over the inner surface 3*a* of the vessel 3.

Figure 4:
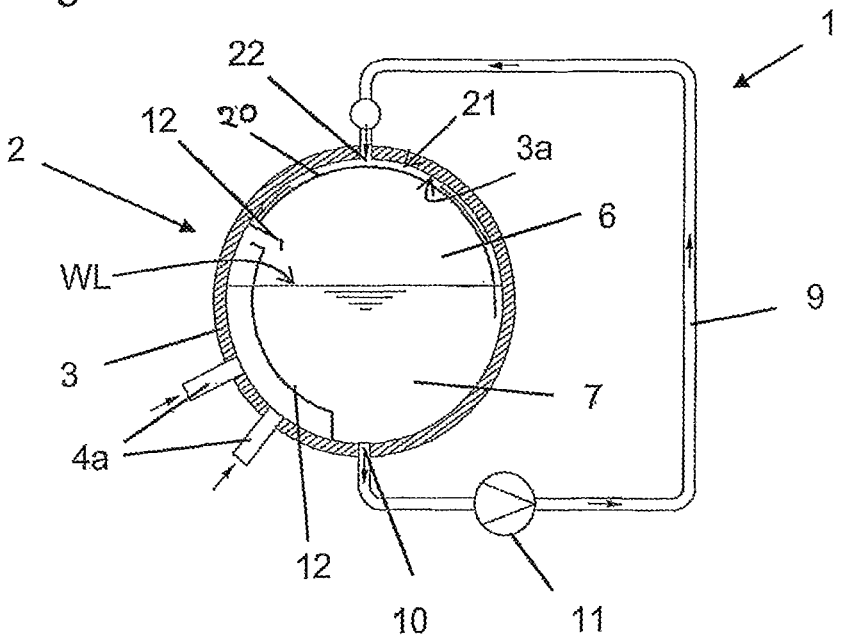
FIG. 4 shows a cross section of a second alternative embodiment of a separator according to the invention.

FIG. 4 shows another alternative embodiment of steam water separator incorporating a wetting device according to the invention. The same or corresponding parts of the water steam separator 1 have been indicated by the same reference numerals.

In the embodiment of FIG. 4 a wall element 20 is provided in the interior of the vessel. The wall element 20 is a plate shaped element which is shaped in conformity with the inner surface 3*a* of the vessel wall 3. The form and location of the wall element 20 is chosen such that the distance between the wall element 20 and the inner surface 3*a* is relatively small and substantially equal over the surface area of the wall element 20. Between the wall element 20 and the inner surface 3*a* a wetting water space 21 is formed. At the top side of the vessel a wetting water inlet 22 is provided which opens into the wetting water space 21. The wetting water inlet 22 is connected to the wetting water outlet 10 at the bottom side of the vessel 3 via the conduit 9.

The circulation pump 11 may pump water from the wetting water outlet 10 to the wetting water inlet 22 so that the water flows into the wetting water space 21. The wetting water space 21 will be filled with water so that the inner surface 3*a* is mainly in contact with water. As a result, imposed medium temperature on the vessel wall 3 is substantially similar in the steam zone and water zone and expansion and contraction of the vessel wall is even or at least more even than in the absence of a wetting device.

To obtain a constructional less complex wall element 20, the wall element 20 extends along the cylindrical inner surface 3*a* of the vessel wall 2, but not along the axial end walls of the vessel wall. This is also of less importance as the expansion and contraction of these axial end walls play a less important role in the bending of the vessel due to uneven expansion and contraction. When desired the wall element 20 can also be brought into conformity with these axial end walls.

Instead of one wall element 20, two or more wall elements may be provided which are placed adjacent to each other in the longitudinal direction of the vessel 2. Also two or more wetting water inlets 22 may be provided in combination with one or more wall elements 20.

In case the water sticks to the inner surface 3*a* the wall element 20 may only extend over a part of the inner surface 3*a* of the steam zone 6, in particular a top zone of the vessel wall where the wetting water is introduced in the vessel and gravity will have a greater negative influence on the sticking of water on the inner surface 3*a* of the vessel wall 3.

In an alternative embodiment of the invention or in combination with any of the above embodiments, the inner surface 3*a* of the vessel wall 3 may be provided with a hydrophilic layer, for instance a hydrophilic coating, so that the water which is jetted to the inner surface 3*a* or introduced via wetting water inlets 22 at the top side of the vessel, sticks to the inner surface 3*a* while it runs down from the upper region of the vessel to the water zone 7 at the lower side of the vessel 2. In such embodiment in combination with a wetting water inlet 22 it may be advantageous to provide the wetting water inlet 22 with rounded edges so that the wetting water inlet 22 smoothly transfer to the inner surface 3*a* of the vessel wall 3.

In the above embodiments water from out of the vessel is used as wetting water for wetting the inner surface of the vessel wall 3. Other sources of water may also be used as wetting water.

All the above embodiments may be used for a method for separating steam and water, comprising the steps of providing a steam water separator comprising a vessel configured to contain steam and water, at least one inlet for water or a mixture of steam and water, and at least one steam outlet, supplying a mixture of steam and water, and taking out steam via the steam outlet, whereby wetting of an inner surface of the vessel wall above a water level of the vessel is performed to avoid uneven expansion of contraction of the vessel wall.

The application of the apparatus and method is not limited to the above described steam water separator, but also to other vessels wherein steam is separated. For instance, the wetting device according to the invention may be applied in a steam generator or boiler wherein steam is generated and separated by heating water directly in the vessel itself.

The invention claimed is:

1. A Steam water separator, comprising:

a vessel having a vessel wall delimiting an interior of the vessel, wherein the vessel is configured to contain steam in a steam zone and water in a water zone in the interior of the vessel;

at least one inlet for introducing steam, or water, or a mixture of steam and water, in the vessel;

at least one steam outlet for taking steam out of the vessel; and at least one water outlet for taking water out of the vessel; and a wetting device configured to wet an inner surface of the vessel wall in the steam zone with water such that the heat transfer coefficient between the vessel wall and the interior of the vessel is the same in the water zone and the steam zone.

2. The separator of claim 1, wherein the wetting device is configured to provide a water film on the inner surface of the vessel wall.

3. The separator of claim 1, wherein the wetting device comprises one or more nozzles arranged in an interior of the vessel and directed at the inner surface of the vessel wall in the steam zone.

4. The separator of claim 3, wherein the one or more nozzles are directed at substantially the whole inner surface of the vessel wall in the steam zone.

5. The separator of claim 3, wherein the one or more nozzles are directed at only an upper region of the inner surface of the vessel wall in the steam zone.

6. The separator of claim 3, wherein the one or more nozzles are connected to a circulation circuit comprising a conduit connecting a wetting water outlet of the vessel to the one or more nozzles, and a circulation pump to pump water through the conduit.

7. The separator of claim 1, wherein the wetting device comprises a wall element to provide a space between the inner surface of the vessel wall and the wall element, and wherein the wetting device comprises at a top side of the vessel a wetting water inlet to substantially fill the space between the inner surface of the vessel wall and the wall element.

8. The separator of claim 7, wherein the wetting water inlet is connected to a circulation circuit comprising a conduit connecting a water outlet of the vessel to the wetting water inlet, and a circulation pump to pump water through the conduit.

9. The separator of claim 1, wherein the vessel has a substantially cylindrical shape, and wherein, during use, the longitudinal axis of the vessel extends horizontally.

10. A method for separating steam and water in a process with a frequently changing process temperature or in a process which is frequently started and stopped, comprising:

utilizing the steam water separator of claim 1 in a process with a frequently changing process temperature or in a process which is frequently started and stopped to separate steam and water.

11. A method for separating steam and water in a solar power installation, comprising:

utilizing the steam water separator of claim 1 in a solar power installation to separate steam and water.

12. The separator of claim 1, wherein the inner surface of the vessel wall in the steam zone is provided with a hydrophilic layer.

13. A method for separating steam and water, comprising the steps of:

providing a steam water separator comprising a vessel having a vessel wall and configured to contain steam and water, at least one inlet for water or a mixture of steam and water, at least one steam outlet, and at least one water outlet;

supplying a mixture of steam and water;

taking out steam via the steam outlet; and taking out water via the water outlet; and wetting an inner surface of the vessel wall with water above a water level of the vessel such that the heat transfer coefficient between the vessel wall and the interior of the vessel is the same in the water zone and the steam zone.

14. The method of claim 13, wherein the wetting comprises providing a water film over the inner surface of the vessel wall above the water level.

15. The method of claim 13, wherein the method comprises spraying water against the inner surface of the vessel wall.

16. The method of claim 13, wherein the wetting of the inner surface of the vessel wall is performed during start-up and shut-down of the separator.

* * * * *